US006977561B2

(12) United States Patent
Freeman

(10) Patent No.: US 6,977,561 B2
(45) Date of Patent: Dec. 20, 2005

(54) MATCHING FEED PARTIALLY INSIDE A WAVEGUIDE RIDGE

(75) Inventor: Will Freeman, Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/801,165

(22) Filed: Mar. 11, 2004

(65) Prior Publication Data

US 2005/0200423 A1 Sep. 15, 2005

(51) Int. Cl.[7] ..... H01P 5/103
(52) U.S. Cl. ..... 333/26; 333/34

(58) Field of Search ..... 333/26, 33, 34

(56) References Cited

U.S. PATENT DOCUMENTS 3,528,041 A * 9/1970 Honda et al. ..... 333/26

* cited by examiner

*Primary Examiner*—Benny T. Lee
(74) *Attorney, Agent, or Firm*—David S. Kalmbaugh

(57) ABSTRACT

An impedance matching feed is disclosed for use in a ridge waveguide which allows a coaxial transmission line, generally having an impedance of fifty ohm, to be matched to a ridge waveguide of arbitrary impedance. The matching feed consist of a transformer which is located inside the ridge of the waveguide, a probe and a quarter wave choke.

16 Claims, 4 Drawing Sheets

MATCHING FEED PARTIALLY INSIDE A WAVEGUIDE RIDGE

BACKGROUND OF THE INVENTION

1. Field of the Invention

The present invention relates generally to a ridge waveguide. More specifically, the present invention relates to a ridge waveguide resistive type feed with a matching transformer within the ridge of the waveguide which matches a standard coaxial transmission line to a ridge waveguide.

2. Description of the Prior Art

Typically, in a simple transition feed for a waveguide the probe does not touch the upper surface and may require additional elements for impedance matching. One such probe design that extends partially into the waveguide is illustrated in U.S. Pat. No. 5,867,073, to Sander Weinreb and Dean Bowyer which issued Feb. 2, 1999. Disclosed in U.S. Pat. No. 5,867,073 is a transition between a waveguide and a transmission line in which a probe portion of the transmission line extends into the waveguide to electrically field couple signals between the waveguide and transmission line. The transmission line includes a substrate having conductors disposed therein to prevent energy from propagating into the substrate from the waveguide. Since the probe is formed as an integral element of the transmission line, direct coupling of the waveguide's signals to the transmission line occurs.

The probe heights of the type illustrated in U.S. Pat. No. 5,867,073 and in other simple probe transition feeds are generally dimensionally sensitive and often impractical in ridge waveguides when the space from the top of the ridge to the top or upper face of the waveguide is relatively small.

Further, conventional probes are often shaped to successfully match the transmission line's impedance. Other prior well known art resistively matched transitions would require an external impedance matching network when the waveguide impedance differs from the coaxial transmission line impedance.

Accordingly there is a need for a relatively compact, simple in design yet highly effective feed which does not require substantial probe shaping and/or an external matching network to impedance match the waveguide to a coaxial transmission line.

SUMMARY OF THE INVENTION

The impedance matching feed comprising the present invention overcomes some of the difficulties of the past including those mentioned above in that it is a relatively simple in design, yet highly effective for matching the input transmission line impedance, which is generally fifty ohms, to the waveguide impedance. The impedance of the ridge waveguide is an arbitrary impedance, that is it will generally be different than the impedance of the coaxial transmission line.

The impedance matching feed consist of a matching transformer located within the ridge of the waveguide. The feed matches a standard coaxial transmission line, which is generally fifty ohms, and does not require an external matching network. A probe extends, from the transformer, vertically upward within the waveguide's interior to the upper wall of the waveguide and is electrically connected to the waveguide. One end of the waveguide is terminated in a quarter wave choke. The quarter wave choke is a short circuit positioned at one quarter of the waveguide's wavelength.

DETAILED DESCRIPTION OF THE PREFERRED EMBODIMENTS

Figure 1:
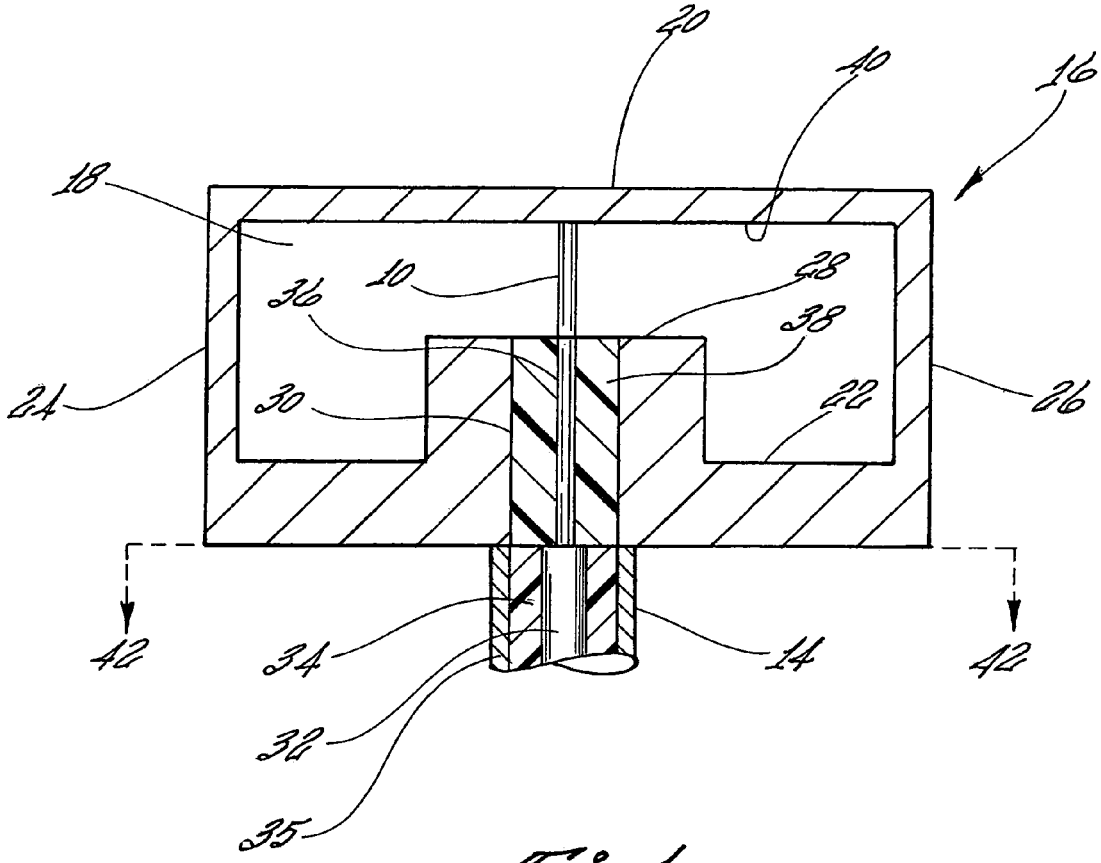
FIG. 1 is a cross sectional view of an impedance matching feed partially located in a ridge waveguide comprising one embodiment of the present invention.

Referring first to FIG. 1, there is shown a probe 10 which couples a coaxial transmission line 14, which is generally a connector, to a hollow metallic waveguide 16. As depicted in FIG. 1, coaxial transmission line 14 is mounted on the bottom surface of waveguide 16. The waveguide 16 may also be a dielectric filled metallic waveguide.

Figure 5:
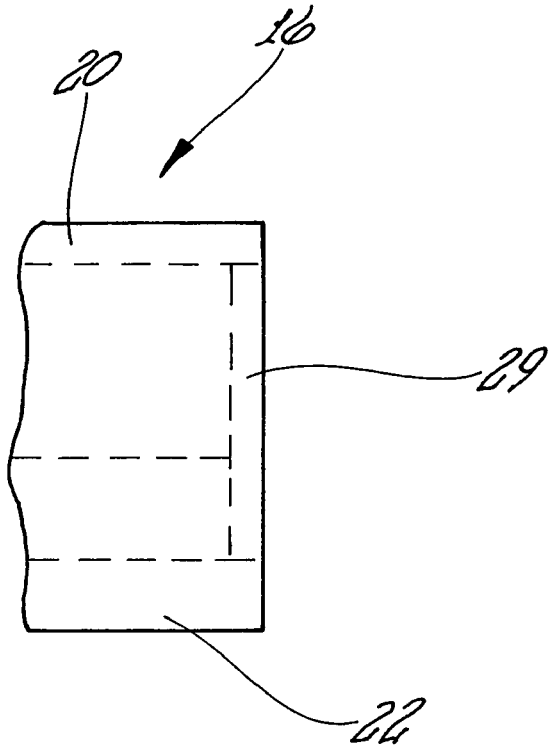
FIG. 5 is an end view of the ridge waveguide of FIG. 1 which illustrates the quarter wave choke positioned at the end of the ridge waveguide.

The waveguide 16 is formed of a hollow interior 18 with open ends to receive and deliver radio frequency signals. Waveguide 16, which has a rectangular shape, includes an upper or top wall 20, a lower or bottom wall 22 and a pair of side walls 24 and 26. A ridge 28, which is located at or near the center of the waveguide 16, runs the length of waveguide 16, and extends vertically upward from bottom or lower wall 22 of the waveguide 16. One end of the waveguide 16 is terminated with a quarterwave choke 29 (FIG. 5). The Quarter wave choke 29 (FIG. 5) is a short circuit positioned at one quarter of the wavelength for waveguide 16 between upper wall 20 and lower wall 22.

A transformer 30 located within ridge 28 electrically connects the probe 10 to the coaxial transmission line 14. Coaxial transmission line 14 typically has an impedance of fifty ohms. Coaxial transmission line 14 includes an inner conductor 32 which may be any electrically conductive material, a dielectric 34 which may be any well known dielectric material, and an outer conductor 35.

As shown in FIG. 1, the transformer 30 consist of a circular inner conductor 36 and a dielectric 38 which surrounds the conductor 36 and is shielded by the metallic ridge 28. Probe 10 is a conductor which extends vertically upward from ridge 28 to the upper wall 20 of waveguide 16. The upper end of probe 10 is electrically connected to the bottom surface 40 of upper wall 20. The conductor 36 of transformer 30 and probe 10 may be fabricated from any well known electrical conductor. Probe 10 couples radio frequency electrical signals between the waveguide 16 and the transmission line 14.

Transformer 30 is shown in FIG. 1 as being positioned above reference plane 42—42. The coaxial transmission line 14 is connected to waveguide 16 below reference plane 42 as shown in FIG. 1. The diameter of transformer 30 is configured to provide an impedance match with the coaxial transmission line 14 at reference plane 42—42.

Figure 2A:
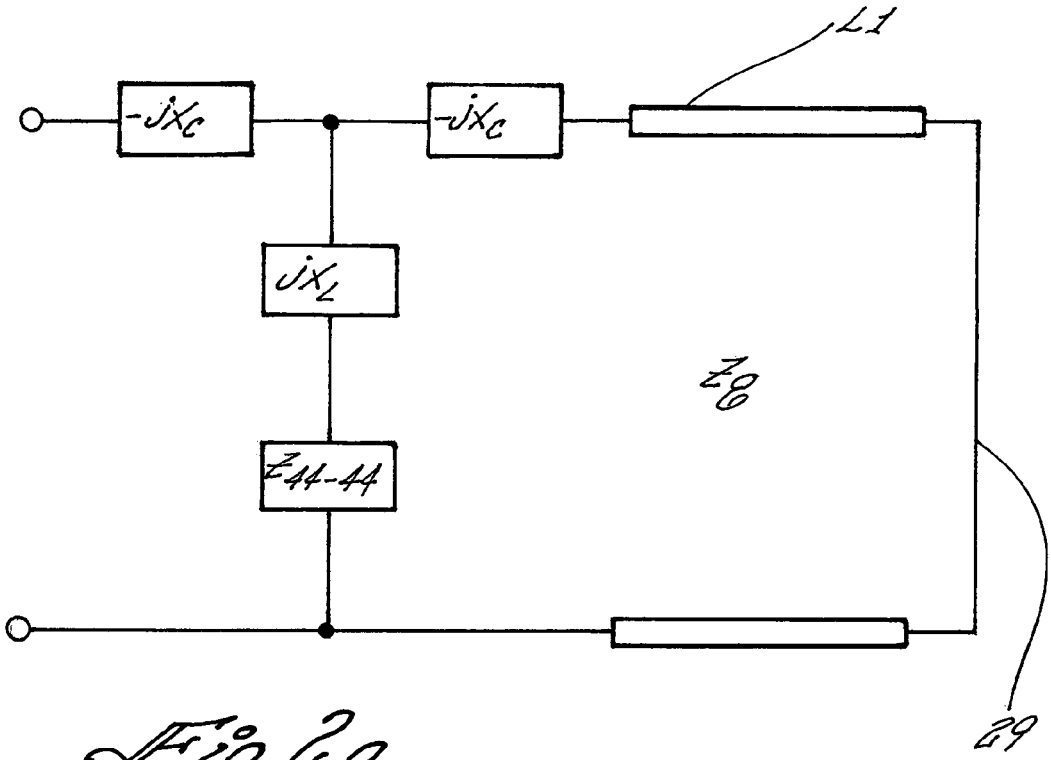
FIGS. 2*a* and 2*b* are electrical equivalent circuit diagrams for the impedance matching feed of FIG. 1.
Figure 2B:
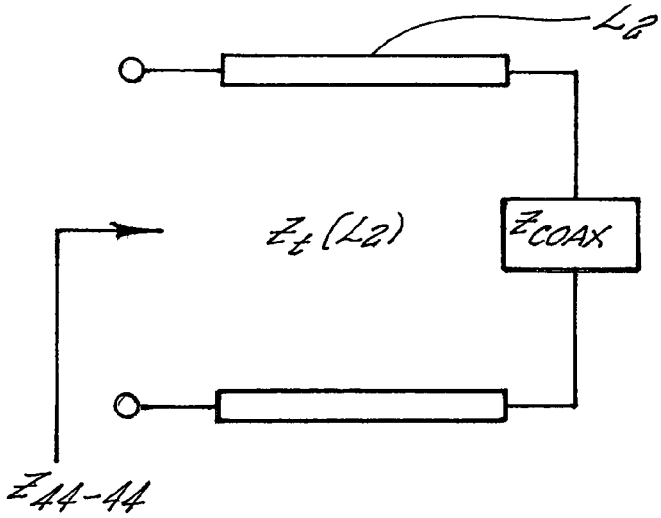

Referring now to FIGS. 1, 2*a* and 2*b*, an electrical equivalent circuit for the feed to the waveguide is depicted in FIGS. 2*a* and 2*b*. In FIGS. 2*a* and 2*b*, $L_1$ (FIG. 2*a*) is the length for the short circuited end of waveguide 16, and $L_2$ (FIG. 2*b*) is the length for transformer 30. $Z_{44\text{-}44}$ (FIG. 2*b*) is the impedance looking into transformer 30 when transformer 30 is terminated with the characteristic impedance for the coaxial transmission line 14. $Z_g$ (FIG. 2*a*) is the waveguide impedance. $Z_{coax}$ (FIG. 2*b*) is the impedance of coaxial transmission line 14 which is normally fifty ohms but $Z_{coax}$ (FIG. 2*b*) may have another value. $Z_t(L_2)$ (FIG. 2*b*) is the impedance of the transformer 30 which can be variable as a function of transformer length, or $Z_t(L_2)$ (FIG. 2*b*) can be a constant impedance.

To obtain an impedance match with coaxial transmission line 14 at reference plane 42—42, the reactances must be tuned out. The diameter of probe 10 may be shaped to tune reactances to a desired level, when needed. Shunt susceptance is made zero by terminating the waveguide with a quarterwave choke. A match occurs when $Z_{44\text{-}44}$ (FIG. 2*b*) is the same as the waveguide impedance $Z_g$ (FIG. 2*a*). Since $Z_{44\text{-}44}$ (FIG. 2*b*) is the impedance looking into transformer 30, the impedance profile $Z_t(L_2)$ (FIG. 2*b*) can be selected to make $Z_{44\text{-}44}$ (FIG. 2*b*) match the waveguide impedance $Z_g$ (FIG. 2*a*).

Thus, the coaxial feed impedance, which is normally fifty ohms, does not have to be the same as the waveguide impedance to obtain a match between the waveguide 16 and the coaxial transmission line 14.

For the relatively simple case of a single step quarter wave transformer, the impedance $Z_t(L_2)$ (FIG. 2*b*) is kept constant and the length $L_2$ (FIG. 2*b*) is selected to be $\lambda/4$ at the operating frequency. The impedance $Z_s$ looking toward the short is:

$$Z_s = jZ_g \tan BL_1 \tag{1}$$

where $Z_g$ is the impedenace of waveguide 16, $B=2\pi/\lambda$ where $\lambda$ the wavelength for waveguide 16, and $L_1$ (FIG. 2*a*) is the length for the short circuited end of waveguide 16, which is an open circuit. The input impedance $Z_{in}$ for the equivalent circuit of FIG. 2*a* becomes:

$$Z_{in} = -jX_c + jX_1 + Z_{44\text{-}44} \tag{2}$$

where $X_c$ (FIG. 2*a*) is the absolute value of the capacitive reactance of waveguide 16, $X_1$ (FIG. 2*a*) is the absolute value of the inductive reactance of wavguide 16, and $Z_{44\text{-}44}$ (FIG. 2*b*) is the impedance looking into transformer 30. When probe 10 is shaped such that the reactances cancel, an impedance match is obtained when $Z_{44\text{-}44}$ (FIG. 2*b*) equals $Z_g$ (FIG. 2*a*). For the single step quarter wave transformer, $Z_t(L_2)$ (FIG. 2*b*) is found from the following equation:

$$Z_t(L_2) = \sqrt{Z_g(Z_{coax})} \tag{3}$$

which is constant as a function of length $L_2$ (FIG. 2*b*).

The matching feed of FIG. 1 works well even when the waveguide impedance is substantially different than the coaxial input impedance due to the transformer contained within the ridge of waveguide 16. The matching feed of FIG. 1 also works well when the space between the top of the waveguide's ridge and the top of the waveguide is relatively short, i.e. substantially less than $\lambda/4$.

Figure 3:
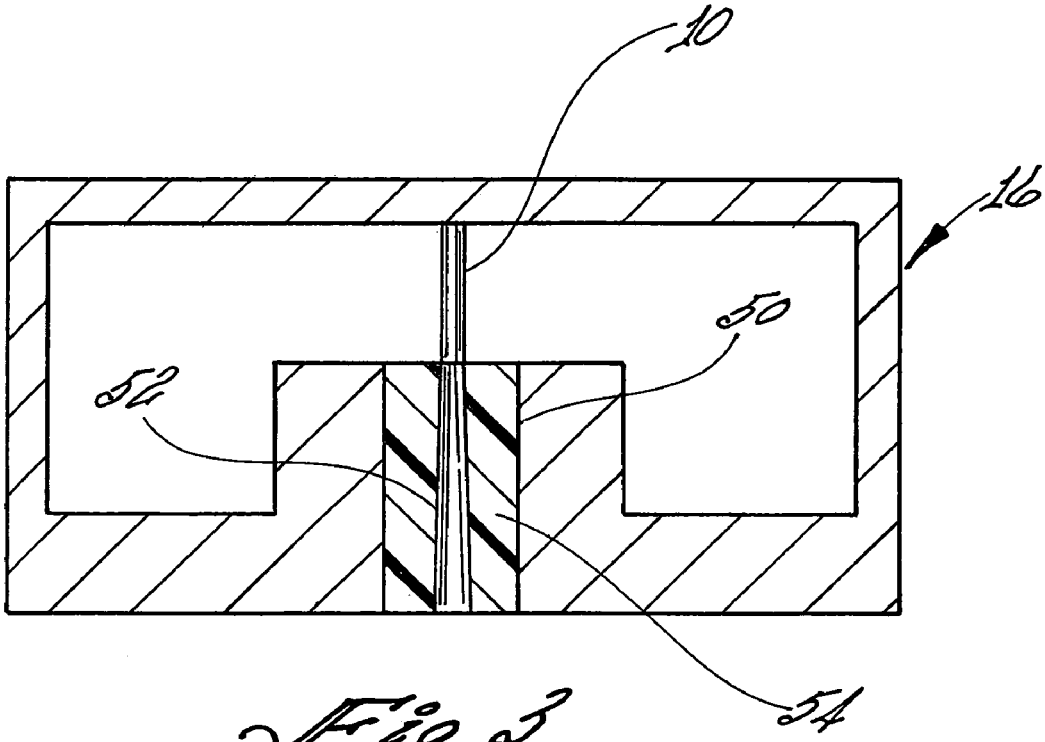
FIG. 3 is a cross sectional view of an impedance matching feed comprising a second embodiment of the invention which has a tapered transformer.
Figure 4:
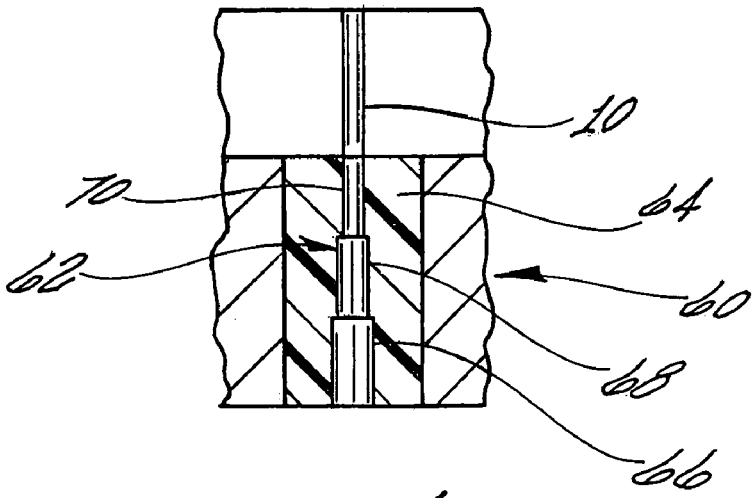
FIG. 4 is a cross sectional view of an impedance matching feed comprising a third embodiment of the invention which has a stepped transformer with each step of the stepped transformer having the same length.

Referring to FIGS. 3, and 4, FIG. 3 depicts a tapered transformer 50 which has a tapered conductor 52 and a dielectric 54 with an outer diameter which is uniform. As shown in FIG. 3, the tapered transformer 50 is electrically connected to probe 10 for waveguide 16. FIG. 4 depicts a transformer 60 which has a stepped conductor 62 and a dielectric 64 which has a uniform outer diameter. The transformer 60 of FIG. 4 has a plurality of steps 66, 68 and 70 with each step 66, 68 and 70 having a different diameter. The lengths of each step 66, 68 and 70 of transformer 60 are usually equal as shown in FIG. 4. As shown in FIG. 4, the stepped transformer 60 is electrically connected to probe 10.

The impedance of the transformers 50 and 60 is $Z_t(L_2)$ which may vary along the length of the transformers 50 and 60. It should be understood that the outer diameters of transformers 50 and 60 can also be made variable stepped or nonuniform with their respective conductors 52 and 62 being constant or variable stepped or nonuniform.

Figure 6:
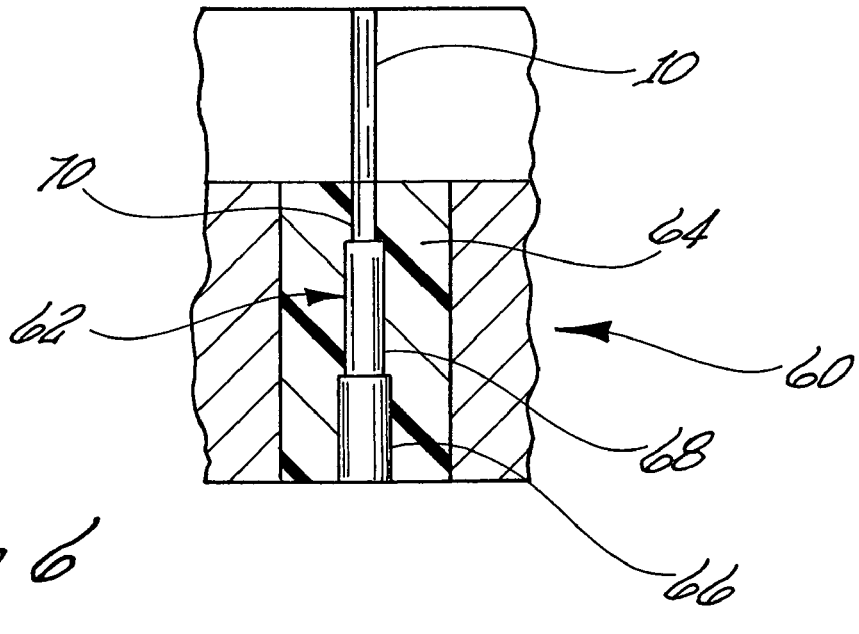
FIG. 6 is a cross sectional view of an impedance matching feed comprising a third embodiment of the invention which has a stepped transformer with each step of the stepped transformer having a different length.

For the stepped version, the number of steps is arbitrary and can be different than the three steps as shown in FIG. 4. The steps 66, 68 and 70 of the stepped transformer 60 may also have different lengths. The transformer 60 illustrated in FIG. 6 has a stepped conductor 62 and a dielectric 64 which has a uniform outer diameter. The transformer 60 of FIG. 6 has a plurality of steps 66, 68 and 70 with each step 66, 68 and 70 having a different diameter. The lengths of each step 66, 68 and 70 of transformer 60 are not equal as shown in FIG. 6. Probe and transformer diameters may also be non-circular.

While FIGS. 3 and 4, show the outer dielectric diameters of the transformer being constant and the inner conductor diameters varying, the inner conductor and the outer dielectric or both may be varied in any manner to obtain the impedance profile needed for the transformer. The impedance matching feed may be used with single and double ridge waveguides, or other waveguide geometries, such as waveguides which are asymmetric. The probe diameter may also be shaped and can have a dielectric material around it. The probe diameter may be different than the diameter of the transformer's inner conductor and it may be shaped such that its radius varies as a function of length.

From the foregoing, it is readily apparent that the present invention comprises a new, unique and exceedingly useful and effective impedance matching feed partially located in a waveguide ridge which constitutes a considerable improvement over the known prior art. Many modifications and variations of the invention are possible in light of the above teachings. It is therefore to be understood that within the scope of the appended claims that the invention may be practiced otherwise than as specifically described.

What is claimed is:

1. An impedance matching feed for matching an impedance for a coaxial transmission line to an impedance for a ridge waveguide, said impedance matching feed comprising:

(a) a transformer having a conductor, a dielectric surrounding said conductor and a length, the dielectric of said transformer having a constant outer diameter along the length of said transformer, said transformer being positioned within a ridge of said ridge waveguide, said transformer having one end connected to said coaxial transmission line, wherein the conductor of said transformer is a stepped conductor having a plurality of steps with each of said plurality of steps having a different diameter and each of said plurality of steps having a different length;

(b) a probe disposed within an interior of said ridge waveguide, said probe having one end connected to the conductor of said transformer and another end connected to an upper wall of said ridge waveguide; and (c) the conductor of said transformer being shaped to match the impedance for said coaxial transmission line to the impedance of said ridge waveguide at a reference plane at a location where said coaxial transmission line is connected to said ridge waveguide, when the impedance of said coaxial transmission line and the impedance of said ridge waveguide differ from one another.

2. The impedance matching feed of claim 1 wherein the conductor of said transformer is shaped to match a fifty ohm impedance for said coaxial transmission line.

3. The impedance matching feed of claim 1 wherein said transformer is centrally located in the ridge of said ridge waveguide and said probe is centrally located within the interior of said waveguide.

4. The impedance matching feed of claim 1 wherein said ridge waveguide is terminated by a quarter wave choke.

5. The impedance matching feed of claim 1 wherein said probe couples radio frequency electrical signals between said ridge waveguide and said coaxial transmission line.

6. The impedance matching feed of claim 1 wherein the conductor of said transformer is comprised of an electrically conductive material, and the dielectric of said transformer is comprised of a dielectric material.

7. An impedance matching feed for matching an impedance for a coaxial transmission line to an impedance for a ridge waveguide, said impedance matching feed comprising:

(a) a transformer having a conductor, a dielectric surrounding said conductor and a length $L_2$, the conductor of said transformer having a diameter configured to provide an impedance match with said coaxial transmission line and the dielectric of said transformer having a constant diameter along the length $L_2$ of said transformer, said transformer having one end connected to the transmission line of said coaxial cable, said transformer being centrally located within a ridge of said ridge waveguide;

(b) a probe disposed within an interior of said ridge waveguide, said probe having one end connected to the conductor of said transformer and another end connected to an upper wall of said ridge waveguide, wherein said probe couples radio frequency electrical signals between said ridge waveguide and the transmission line of said coaxial cable; and (c) said transformer having an impedance $Z_t(L_2)$ which is calculated in accordance with the equation:

$$Z_t(L_2)=\sqrt{Z_g(Z_{coax})}$$

where: $Z_g$ is a waveguide impedance for said ridge waveguide; and $Z_{coax}$ is a transmission line impedance for said coaxial transmission line which is generally fifty ohms, wherein said ridge waveguide is terminated by a quarter wave choke and said length $L_2$ of said transformer is $\lambda/4$ at an operating frequency for said ridge waveguide.

8. The impedance matching feed of claim 7 wherein said probe is comprised of an electrically conductive material.

9. The impedance matching feed of claim 7 wherein the conductor of said transformer is comprised of an electrically conductive material, and the dielectric of said transformer is comprised of a dielectric material.

10. The impedance matching feed of claim 7 wherein said transformer is a single step quarter wave transformer.

11. An impedance matching feed for matching an impedance for a coaxial transmission line to an impedance for a ridge waveguide, said impedance feed comprising:

(a) a transformer having a conductor, a dielectric surrounding said conductor and a length $L_2$, the conductor of said transformer having a diameter configured to provide an impedance match with said coaxial transmission line and the dielectric of said transformer having a constant diameter along the length $L_2$ of said transformer, said transformer having one end connected to said coaxial transmission line, said transformer being positioned within a ridge of said ridge waveguide;

(b) a probe disposed within an interior of said ridge waveguide, said probe having one end connected to the conductor of said transformer and another end connected to an upper wall of said ridge waveguide; and (c) said transformer having an impedance $Z_t(L_2)$ which is calculated in accordance with the equation:

$$Z_t(L_2)=\sqrt{Z_g(Z_{coax})}$$

where: $Z_g$ is a waveguide impedance for said ridge waveguide; and $Z_{coax}$ is a coaxial transmission line impedance for said coaxial cable.

12. The impedance matching feed of claim 11 wherein said probe couples radio frequency electrical signals between said ridge waveguide and said coaxial transmission line.

13. The impedance matching feed of claim 11 wherein said probe is comprised of an electrically conductive material.

14. The impedance matching feed of claim 11 wherein the conductor of said transformer is comprised of an electrically conductive material, and the dielectric of said transformer is comprised of a dielectric material.

15. The impedance matching feed of claim 11 wherein said transformer is a single step quarter wave transformer.

16. The impedance matching feed of claim 11 wherein said ridge waveguide is terminated by a quarter wave choke.

* * * * *